United States Patent [19]

Gagliardo et al.

[11] 4,143,717

[45] Mar. 13, 1979

[54] NOZZLE

[75] Inventors: John P. Gagliardo, Shrewsbury; Fay A. Purvis, Sutton, both of Mass.

[73] Assignee: Feecon Corporation, Westboro, Mass.

[21] Appl. No.: 834,704

[22] Filed: Sep. 19, 1977

[51] Int. Cl.[2] ..... B05B 7/12

[52] U.S. Cl. ..... 169/15; 239/407; 239/428.5

[58] Field of Search ..... 169/14, 15, 24; 239/390–392, 394, 396, 406, 407, 416.5, 428.5, 441, 443, 449; 261/116

[56] References Cited

U.S. PATENT DOCUMENTS

| | | | |
|---|---|---|---|
| 618,412 | 1/1899 | Haas et al. | 239/441 |
| 2,405,375 | 8/1946 | Smith | 239/416.5 X |
| 2,485,723 | 10/1949 | Fitzgerald | 169/14 |
| 2,532,986 | 12/1950 | Bedford et al. | 169/15 |
| 2,990,165 | 6/1961 | Joseph | 169/15 X |
| 3,188,009 | 6/1965 | Miscovich | 169/15 X |

*Primary Examiner*—Johnny D. Cherry

*Attorney, Agent, or Firm*—Norman S. Blodgett; Gerry A. Blodgett

[57] ABSTRACT

Nozzle having a housing with a cylindrical inner surface and with a fixed wall extending at a right angle to its axis. A movable wall is mounted in the housing adjacent the fixed wall and is rotatable about the axis, so that a pattern of apertures in the movable wall match similar apertures in the fixed wall to control flow of fluid therethrough.

10 Claims, 6 Drawing Figures

NOZZLE

BACKGROUND OF THE INVENTION

In the design and operation of nozzles of the type used in fire fighting, there are a number of difficult problems to solve. One of these problems lies in the fact that, when the quantity of fluid is changed, force couples may be generated to make the nozzle difficult to handle. Such force couples can be produced by a non-symmetrical flow of fluid passing through the nozzle. Attempts to overcome these difficulties in the past have resulted in very complex and expensive mechanisms which were easily rendered inoperative and which were subject to a considerable amount of maintenance. The main problem, however, lies in the fact that, so far as generating foam is concerned, there is only one flow rate at which the foam is most effectively formed. In the past, it has been common practice to use a single tube nozzle and to change the flow rate simply by using one, two, or three apertures or orifices, as the demand called for greater flow. If the apparatus was designed for the most effective formation of foam with one aperture, then, when more than one aperture was used, the foam generated was inadequate. In order to overcome this difficulty, some nozzles are designed with a plurality of tubes and the quantity of fluid was determined by using one, two, or more of the tubes. While each tube generates the foam effectively, unfortunately it is necessary for at least one of the tubes to be spaced from the pivotal axis of the nozzle and the force couple set up is extremely great, making it difficult to control the direction in which the nozzle is pointed. An indication of the order of magnitude of forces developed can be understood when it is known that, when a flow of 2400 gallons per minute takes place at 200 psi, the force developed is 1700 lbs. While many nozzles have their turning and directional stability controlled with a power assist of a hydraulic type, a force couple requires the use of larger and more expensive equipment. Furthermore, there are instances when the nozzle must be manipulated manually. At that time the force couple generated at high flow rates makes the nozzle very difficult (and even hazardous) to handle. These and other difficulties experienced with the prior art devices have been obviated in a novel manner by the present invention.

It is, therefore, an outstanding object of the invention to provide a nozzle capable of operation at high flow rates with effective generation of foam, but with no appreciable force couple about the nozzle pivot.

Another object of this invention is the provision of a nozzle in which the flow rate can be increased in multiples of a base flow rate by a simple manipulation.

A further object of the present invention is the provision of a nozzle in which the generation of foam remains the same at flow rates which are multiples of a base flow rate.

It is another object of the instant invention to provide a nozzle for the generation of foam whose construction is simple, which can be easily manufactured from readily available materials, and which is capable of a long life of useful service with a minimum of maintenance.

With these and other objects in view, as will be apparent to those skilled in the art, the invention resides in the combination of parts set forth in the specification and covered by the claims appended hereto.

SUMMARY OF THE INVENTION

In general, the invention consists of a nozzle having an inner tube and an outer tube which is generally concentric with the inner tube. A fixed wall element extends between the inner surface of the outer tube to the outer surface of the inner tube, the wall element having a plurality of apertures extending axially therethrough. A movable wall element is rotatably carried between the inner and the outer tube adjacent the fixed wall element. The movable wall element has a plurality of apertures extending axially therethrough and means is provided for rotating the movable wall element from a first position (in which the apertures in the movable wall element are not coincidential with the apertures in the fixed wall element and fluid flows through the inner tube only) to a second position in which the apertures match and fluid flows through both tubes.

More specifically, the total cross-sectional area of the apertures in the movable wall element equals the cross-sectional area of the inner tube. A stub tube extends slidably through a coaxial bore in the fixed wall element, the movable wall element having a similar coaxial bore that fits snugly around the outer surface of the stub tube.

BRIEF DESCRIPTION OF THE DRAWINGS

The character of the invention, however, may be best understood by reference to one of its structural forms, as illustrated by the accompanying drawings, in which.

DESCRIPTION OF THE PREFERRED EMBODIMENT

Figure 1:
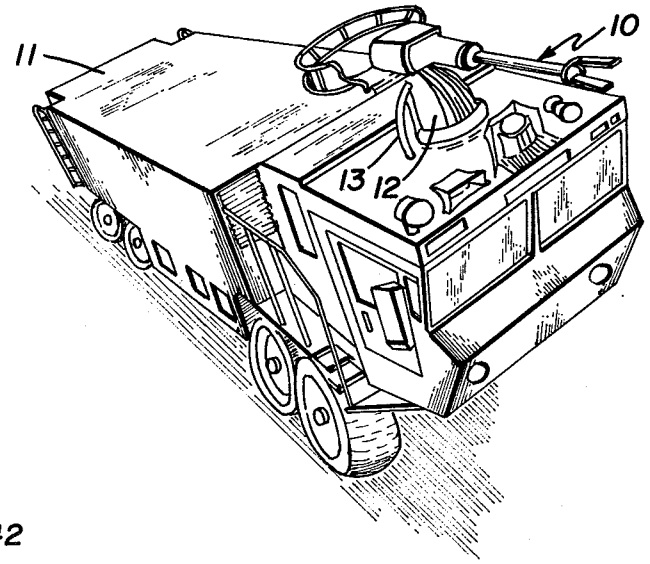
FIG. 1 is a perspective view of a fire truck carrying a nozzle constructed in accordance with the principles of the present invention.

Referring first to FIG. 1, wherein is best shown the general features of the invention, the nozzle, indicated generally by the reference numeral 10, is shown in use with a turret 12 mounted on the cab of a fire truck 11. A fluid conduit 13 extends into the turret and receives a fire-extinguishing foam slurry from the truck pump.

Figure 2:
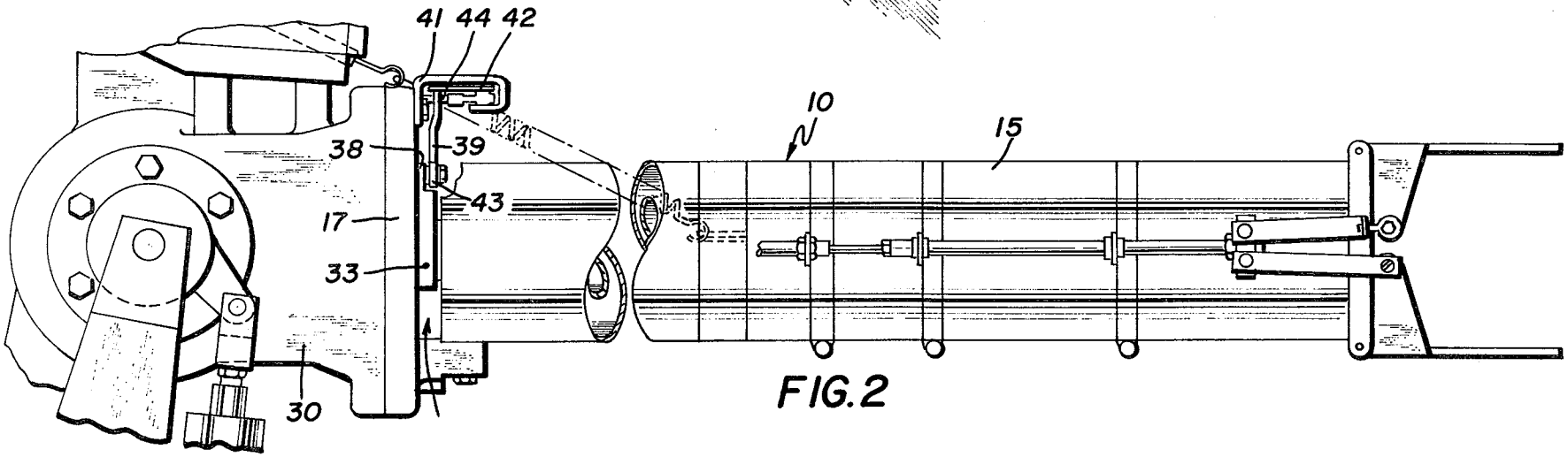
FIG. 2 is a side elevational view of the nozzle.

In FIG. 2 is can be seen that the nozzle is provided with an outer tube 15 attached to a housing 30, having an inner chamber which is connected to the fluid conduit 13.

Figure 4:
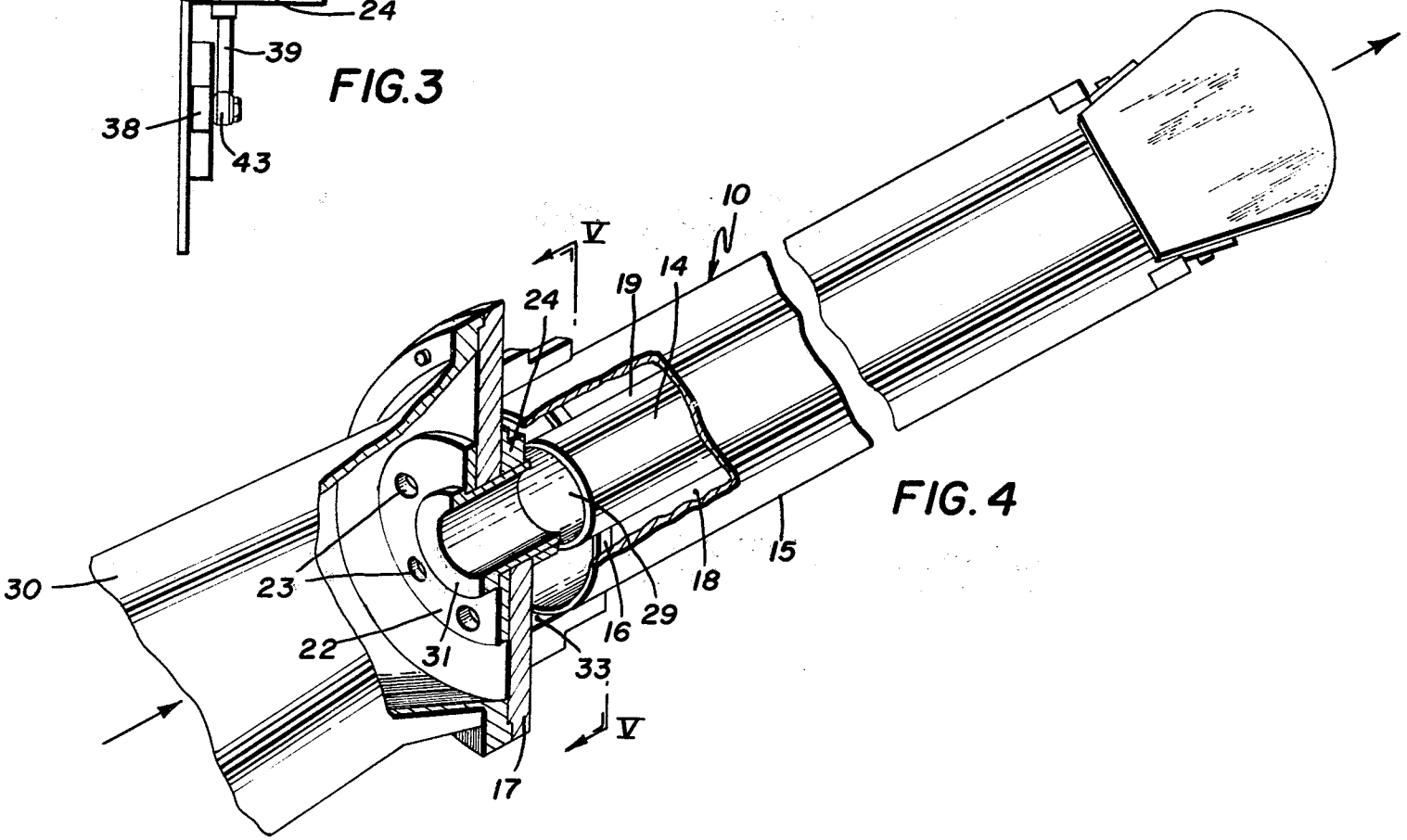
FIG. 4 is a perspective view with portions broken away of the nozzle.
Figure 5:
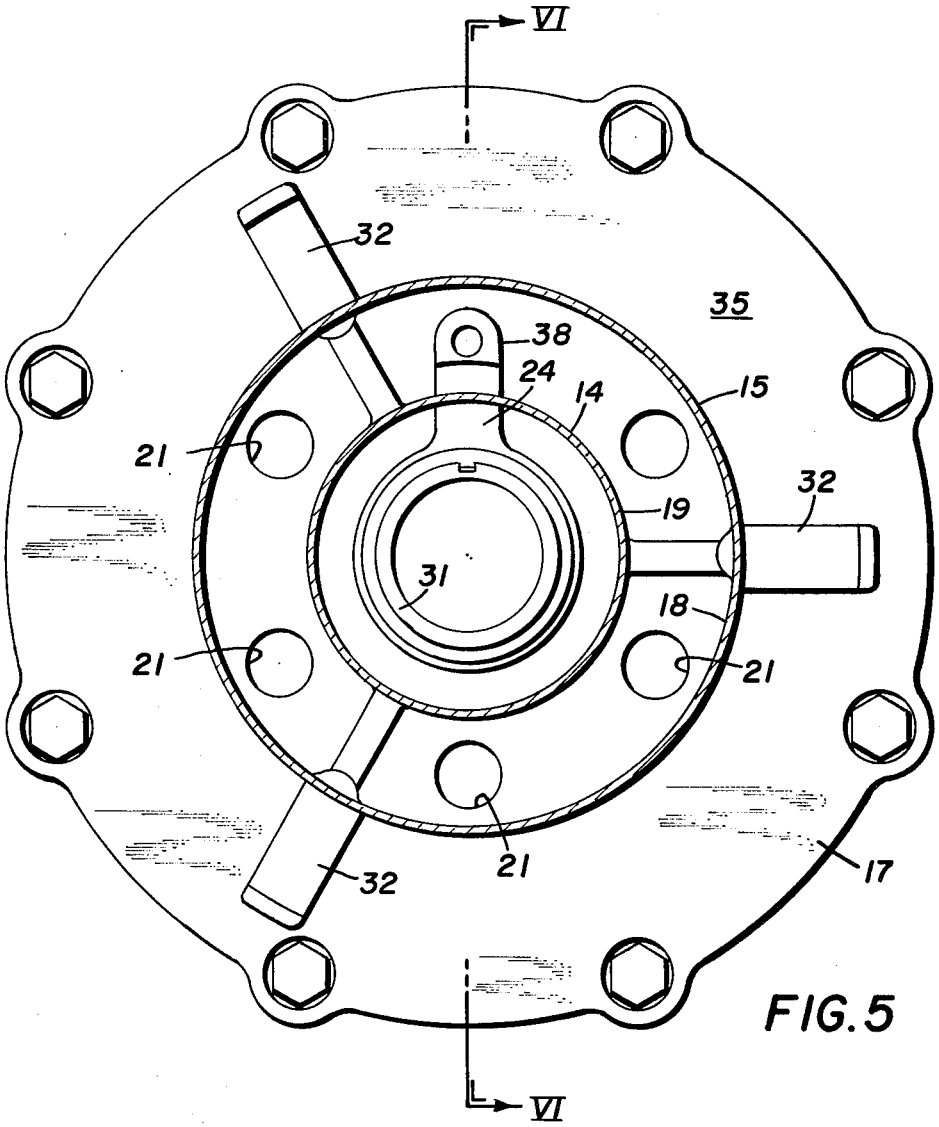
FIG. 5 is a sectional view of the nozzle taken on the line V—V of FIG. 4.

As is evident in FIG. 4, the nozzle is also provided with an inner tube 14, the inner and outer tubes being concentric and held in fixed relationship by pillars 16. A fixed wall element 17 (whose details are shown in FIG. 5) extends between the imaginary cylinders defined by the inner surface 18 of the outer tube 15 and an extension of the outer surface 19 of the inner tube 14. As is best evident in FIG. 5, the wall element 17 is provided with a plurality of apertures 21 which extend axially therethrough and which are evenly spaced about the axis of the inner tube 14 with their centers located on a circle which is also concentric with the axis.

A movable wall element 22 (FIG. 6) is rotatably mounted adjacent the fixed wall element 17 and is provided with a plurality of apertures 23 which extend axially therethrough, these apertures having the same spacing and having their centers mounted on the same circle as the apertures 21 of the fixed wall. A means 24 is provided for rotating the movable wall element 22 from a first position in which the apertures 23 are not congruent with the apertures 21 in the fixed wall element 17 (and fluid flows through the inner tube 14 only) to a second position in which they are congruent and fluid flows through both tubes. The total cross-sectional area of the apertures 21 equals the cross-sectional area of an inner tube 31.

Figure 6:
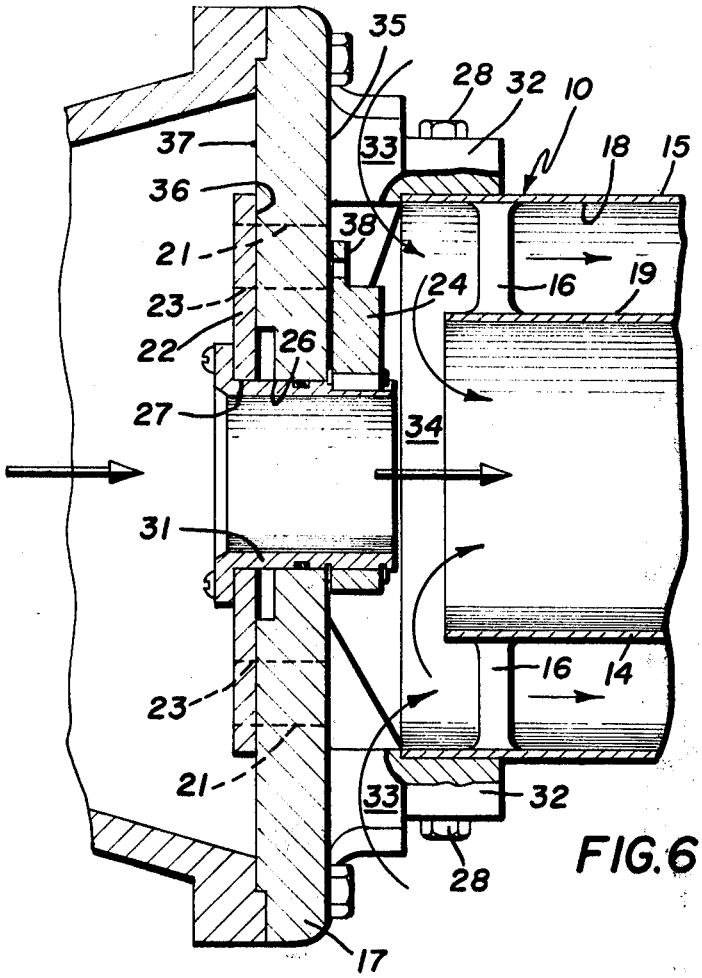
FIG. 6 is a vertical sectional view of the nozzle taken on the line VI—VI of FIG. 5.

Referring to FIG. 6, it can be seen that the short stub inner tube 31 extends rotatably through a coaxial bore 26 in the fixed wall element, the movable wall element having a coaxial bore 27 that fits around the outer surface of the stub tube. The outer tube 15 is fixedly attached to the fixed wall 17 by bolts 28.

The fixed wall element 17 is generally disc-like in configuration and is provided with axially-extending abutments 32 that extend downstream from one side surface 35. The abutments are equally spaced about the periphery and have the outer tube fastened thereto by means of the bolts 28. A substantial gap 33 exists between the said one side surface 35 of the fixed wall element 17 and the adjacent end of the outer tube 15 for the admission through the gap of air for foaming. There is a similar substantial gap 34 between the adjacent ends of the inner tube 14 on the one hand and the surface 35, this gap allowing air to be admitted to the interior of the inner tube 14 for foaming.

As has been shown, the movable wall element 22 is mounted on and attached to the rotatable stub tube 31 and has a flat surface 36 facing and sliding over the other side surface 37 of the fixed wall element. A crank arm 38 is mounted on and keyed to the movable short tube 31 adjacent the said one side surface 35 of the fixed wall element.

Figure 3:
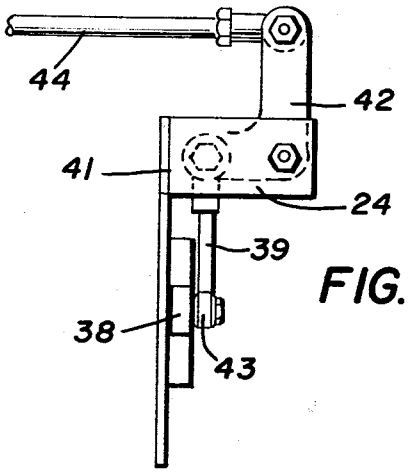
FIG. 3 shows the detail of a mechanism used in the invention.

As is best shown in FIGS. 2 and 3, an actuating lever 39 extends through the gap 33 between the outer tube 15 and the fixed wall element and has one end connected by a ball joint 43 to the crank arm 38. The other end of the actuating lever 39 lies outside the outer tube 15 to permit movement of the crank arm and of the movable stub tube, as well as of the movable wall element 22. A bracket 41 is mounted on the outer periphery of the fixed wall element 17 and a bell crank 42 is pivotally mounted on the bracket for pivotal movement about an axis that is perpendicular to the tube axis. A control rod 44 is connected to the outer end of the other arm of the bell crank 42.

The operation and the advantages of the present invention will now be readily understood in view of the above description. When the pump on the fire truck 11 is operative to provide pressure in the fluid conduit 13, the fluid is admitted to the chamber of the housing 30 under pressure. In the preferred embodiment, the fluid is a mixture of water and a foaming agent. Assuming that the movable wall element 22 is rotated to a position in which the apertures 23 are noncoincidental with the apertures 21 in the fixed wall element 17, the only flow of fluid is through the stub tube 31 which acts as an orifice. Fluid passes from the outboard end of the tube 31 into the inner end of the inner tube 14. As it passes across the gap 34, it aspirates air which mixes with the liquid and forms the foam. Air arrives by passing through the gap 33 into the chamber provided by the spaces between the abutments 32 and is, therefore, able to enter the annular gap 34. As the foam leaves the other end of the tube 14, it can be controlled by suitable deflectors. Also, the general direction is determined by the angle to which the nozzle 10 has been pivoted about the vertical axis provided in the turret 12 on the top of the fire truck. If a greater flow of foam is desired, it is possible by actuating the control rod 44, to rotate the movable wall element 22 to a position in which the apertures 23 are congruent or coincidental with the apertures 21. At that time, it is possible for fluid to flow from the housing 30 first through each of the apertures 23 and then through its corresponding aperture 21 in the fixed wall element 17. In the preferred embodiment there are six of these apertures sets arranged at an angle of 60° about a circle concentric with the axis of the inner tube 14. The fluid passing through the orifice, formed by each of the two cooperating bores or apertures, enters the space between the outer surface of the inner tube 14 and the inner surface of the outer tube 15. In its passage, it aspirates air through the gap 33 and the mixture of the air and solution causes foaming to take place. The foam generated in this way passes down the passage between the inner and the outer tubes and eventually leaves the end of the nozzle where it can be controlled in the same way as has been described for foam leaving the inner tube 14.

It can be seen that, when the fluid passes through the stub tube 31 into the inner tube 14, no force couple is produced, since the axis of the tube 14 passes through the vertical pivotal axis of the turret 12. Even though the reaction force may be quite considerable, it presents no problem because it is carried without difficulty by the vertical bearings in the turret. This applies also to any horizontal pivot which may exist in the turret. Nevertheless, when the flow is doubled, the reaction forces become quite considerable. In the case of the present invention, however, because the orifices formed by the apertures 21 in the fixed wall element 17 and the apertures 23 in the movable wall element 22 are equally spaced about the axis of the inner tube 14 the reaction forces equalize one another.

In the preferred embodiment, the provision of six sets of orifices means that each orifice has its reaction force exactly balanced by another orifice which has the same moment arm. The effect is that there is no reaction force to rotate the nozzle either about a vertical axis or a horizontal axis in the turret 12. At the same time, the inner tube 14 and the outer tube 15 can be selected of such a size that the flow of fluid combined with the aspirated air produces the most effective production of foam in both tubes, so that the foam leaving the end of the nozzle is of equally high quality whether it originates in the inner tube 14 or in the space between the inner tube 14 and the outer tube 15. Also, the stream range is maximum whether full or half flow rate. As evident in the preferred embodiment, there are very few movable parts and those parts that are used are so simple as to obviate any problem of accumulation of material that would require a high degree of maintenance to keep them clean. Furthermore, the simple nature of the parts means that they will have a long life and will not be subject to breakage or wear even under the most adverse conditions.

It is obvious that minor changes may be made in the form and construction of the invention without departing from the material spirit thereof. It is not, however, desired to confine the invention to the exact form herein shown and described, but is desired to include all such as properly come within the scope claimed.

The invention having been thus described, what is claimed as new and desired to secure by Letters Patent is:

1. A nozzle, comprising:

(a) an inner tube, (b) an outer tube generally concentric with the inner tube, (c) a fixed wall element extending inwardly of the inner surface of the outer tube, the wall element having a plurality of apertures extending axially therethrough, (d) a movable wall element is rotatably mounted adjacent the fixed wall element, the movable wall element having a plurality of apertures extending therethrough, and (e) means for rotating the movable wall element from a first position in which the apertures in the movable wall element are not congruent with apertures in the fixed wall element and fluid flows through the inner tube only to a second position in which they are congruent and fluid flows through both tubes.

2. A nozzle as recited in claim 1, wherein the total cross-sectional area of the apertures in the fixed wall element equals the cross-sectional area of the inner tube.

3. A nozzle as recited in claim 1, wherein a short tube extends rotatably through a coaxial bore in the fixed wall element, the movable wall element having a coaxial bore that fits around the outer surface of the short tube.

4. A nozzle as recited in claim 1, wherein the outer tube is fixedly attached to the fixed wall element.

5. A nozzle as recited in claim 4, wherein the fixed wall element is generally disc-like in configuration and is provided with axially-extending abutments extending downstream from one side surface, the abutments being equally spaced about the periphery and having the outer tube fastened thereto, there being a substantial gap between the said one side surface of the fixed wall element and the adjacent end of the outer and inner tubes for the admission of air for foaming.

6. A nozzle as recited in claim 5, wherein the movable wall element is mounted on a movable short tube and has a flat surface facing and slidable over the other side surface of the fixed wall element, and wherein a crank arm is mounted on the movable short tube adjacent the said one side surface of the fixed wall element.

7. A nozzle as recited in claim 6, wherein an actuating lever extends through the said gap between the end of the outer tube and the fixed wall element, has one end connected by a ball joint to the crank arm, and has the other end lying outside the outer tube to permit movement of the crank arm, movable short tube, and movable wall element.

8. A nozzle as recited in claim 7, wherein a bracket is mounted on the outer periphery of the fixed wall element, wherein a bell crank is pivotally mounted on the bracket for pivotal movement about an axis that is perpendicular to the axis of the inner tube, and wherein the said other end of the lever is connected to the outer end of one arm of the bell crank.

9. A nozzle as recited in claim 8, wherein a control rod is connected to the outer end of the other arm of the bell crank.

10. A nozzle, comprising:

(a) a housing having a chamber, (b) an outer tube fixed to the housing, (c) an inner tube fixedly mounted to the outer tube concentrically thereof, (d) a fixed wall element extending transversely of the outer tube and having a coaxial bore located adjacent the end of the inner tube, a plurality of apertures extending through the wall element to provide for flow of fluid from the chamber into the space between the inner and the outer tubes, the total area of the apertures being approximately equal to the cross-sectional area of the inner tube, and (e) means for opening and closing the apertures as desired.

* * * * *